US006499177B2

(12) United States Patent
Napolitan

(10) Patent No.: US 6,499,177 B2
(45) Date of Patent: Dec. 31, 2002

(54) CORNER PAINT ROLLER

(76) Inventor: Walter D. Napolitan, 125 Crestview Dr., Barto, PA (US) 19504

( * ) Notice: Subject to any disclaimer, the term of this patent is extended or adjusted under 35 U.S.C. 154(b) by 161 days.

(21) Appl. No.: 09/727,455

(22) Filed: Dec. 4, 2000

(65) Prior Publication Data

US 2001/0025394 A1 Oct. 4, 2001

Related U.S. Application Data

(63) Continuation-in-part of application No. 09/478,344, filed on Jan. 6, 2000, now Pat. No. 6,185,780.

(51) Int. Cl.[7] ..... B05C 17/02
(52) U.S. Cl. ..... 15/230.11; 15/246; 492/13
(58) Field of Search ..... 15/230.11, 246; 492/13, 19, 17

(56) References Cited

U.S. PATENT DOCUMENTS

| | | | | |
|---|---|---|---|---|
| 2,763,022 A | | 9/1956 | Glacken | 15/248.2 |
| 2,959,800 A | | 11/1960 | Bischoff | 401/16 |
| 2,972,158 A | | 2/1961 | Voskresenski | 15/244.2 |
| 4,402,102 A | | 9/1983 | Al-Samman | 15/230.11 |
| 5,167,055 A | | 12/1992 | Stoddart et al. | 492/13 |
| 5,419,003 A | | 5/1995 | Tollasepp | 15/230.11 |
| 5,584,092 A | | 12/1996 | Polzin et al. | 15/230.11 |
| 5,613,264 A | | 3/1997 | Knowles | 15/230.11 |
| 5,613,265 A | | 3/1997 | Gemmell | 15/230.11 |
| 6,098,240 A | * | 8/2000 | Taylor | 15/230.11 |

FOREIGN PATENT DOCUMENTS

DE 3903-519 A 8/1990

* cited by examiner

*Primary Examiner*—Gary K. Graham
(74) *Attorney, Agent, or Firm*—Siemens Patent Services, LC

(57) ABSTRACT

A novel end cap assembly for attachment to a commercially available paint roller assembly allows the application of a coating material, such as paint, uniformly to two intersecting surfaces such as in a corner. The inventive end cap comprises a unitary disc like base having a prong projecting laterally therefrom, the base and prong being formed unitarily from a suitable polymer. A textured material such as fabric, open celled foam, or sheepskin bearing natural wool is adhered to the base. A single prong engages a space existing between the inner surface of the roller cover and the outer surface of the roller frame barrel so that the possibility of damage to the possibly damp paper tube of the roller cover is avoided when the end cap is installed. The prong is straight where joined to the cap at its proximal end, and is curved at its distal or free end. The prong is formed from a material imparting spring qualities.

13 Claims, 4 Drawing Sheets

CORNER PAINT ROLLER

REFERENCE TO RELATED APPLICATION

This application is a Continuation-in-part of Ser. No. 09/478,344, filed Jan. 6, 2000 now U.S. Pat. No. 6,185,780.

BACKGROUND OF THE INVENTION

1. Field of the Invention

The present invention relates to apparatus for uniformly spreading a coating on a surface, and more specifically to a paint roller adapted to apply paint simultaneously to two perpendicular, intersecting environmental surfaces being painted. It is contemplated that manual painting in commercial, residential, institutional, and industrial facilities will provide the most widespread application of the invention. However, any task requiring that a viscous fluid be applied as a coating to an environmental surface having intersecting, non-parallel surfaces will benefit from the invention.

2. Description of the Prior Art

Paint rollers have gained wide acceptance as the implement of choice for spreading a coating on many flat surfaces. Coatings such as paint, stain, varnish, sealer, waterproofing and the like may be readily applied with a roller to horizontal and vertical surfaces by essentially untrained operators with generally acceptable results. A wide variety of paint rollers assemblies are currently available, the "standard" roller including a replaceable roller cover, a barrel or cage portion for supporting the roller cover, and a frame with a handle. Roller covers are available in a wide variety of naps designed for painting a variety of surface textures ranging from smooth (such as finished plaster) to extremely rough surfaces, such as stucco. When a conventional paint roller is used in a corner (i.e., where two perpendicular surfaces meet), one of two outcomes is desired. Sometimes, it is desirable to prevent the coating being applied to one of the surfaces from contacting the adjoining, intersecting surface. More often however, the coating being applied will be continued from the first surface onto the second surface. Traditional paint rollers exhibit notoriously poor performance in corners, often necessitating the painter "cutting in" the corners with a conventional paint brush or similar tool. "Cutting in" is an informal term for correcting unsatisfactory results by an alternative manual painting method.

U.S. Pat. No. 4,402,102, for CORNER PAINT ROLLER; issued Sep. 6, 1983, to Ziad A. Al-samman, teaches a corner-painting assembly attachable to the end of a conventional paint roller. The end surface of the Al-samman apparatus may be either bristle-like to simulate a paint brush, or may be of the same material and textures as the outer surface of the roller cover. The end cap apparatus is fastened to the roller core by prongs specifically adapted to interact with wire members forming the core of the paint roller frame. The junction between the edge of the roller cover and the insertable end cap is uncontrolled and in use, a nonuniform deposition of coating on at least one the two perpendicular surfaces often results. In contradistinction, the inventive paint roller end cap apparatus is designed for retention in the end of a conventional paint roller cover by at least one prong adapted to fit between the inner diameter of the roller cover and the outer diameter of the barrel or cage. This means that the inventive end cap may be applied universally to any paint roller, not just to one specific brand or design as is the case with the Al-samman apparatus. The prong occupies only a limited portion of the circular cap, whereas Al-sammam has corresponding structure having a plurality of prongs located periodically along a entire circular path on the base. It should be noted that installing the cap of Al-sammam may not be readily accomplished since it is difficult to assure that each prong is appropriately aligned for insertion. By contrast, the prong in the present invention does not engage any specific element of the roller, which makes it easy to align for insertion. The prong in the present invention has configuration different from any of those of Al-sammam. In addition, texture of the coating applicator surface of the inventive end cap is carefully formed to abut the edge of the roller cover so that in use, a smooth, continuous coating can be applied to both intersecting surfaces.

Another U.S. Pat. No. 5,584,092 for ROLLER HAVING SLIP-ON CAGE FOR PAINT ROLLER COVER; issued Dec. 17, 1996, to Bruce C. Polzin, et al., describes a one-piece roller assembly which is closed at one end, and terminates in a rounded tip portion at the opposite end. The Polzin, et al. system necessitates the use of two different roller assemblies for coating jobs where both a "continue around a corner" and also a "stop at the corner" mode of operation are required. Either two roller covers must be cleaned and the paint remaining in the covers at the end of the job wasted, or both roller covers must be discarded. The inventive end cap system, on the other hand, requires the cleaning or discarding of only a single roller cover. The inventive end cap may be installed or removed as required throughout the coating job. The minuscule amount of paint remaining in the paint holding medium of the inventive end cap presents a trivial clean up job and only a small amount of the coating material remains in the paint holding medium of the end piece. The inventive system also produces a uniform deposition of coating material on both surface proximate the corner while the Polzin, et al. cover may not deposit coating material uniformly near the corner because of its nonconforming, conical contour. Polzin et al. lacks the end cap bearing bristles on the end of the cylinder, wherein the end cap has a single attaching prong. The present invention has these features.

U.S. Pat. No. 5,613,264 for PAINT ROLLER CORNER COVER; issued Mar. 25, 1997, to Curtis N. Knowles, teaches another insertable end cap for corner painting. The Knowles apparatus lacks the controlled edge contour of the inventive end cap, resulting in coating non-uniformity when used in a corner. The Knowles design uses an annular flange for insertion into the open end of a paint roller with a series of integrally molded, circumferentially spaced lugs protruding from the flange for engagement with the inside of the roller cover. A significant difference between Knowles and the present invention is that whereas the annular flange forms a full circle, the present invention utilizes a corresponding member which extends along only a limited portion of a circle. Also, thickness of the Knowles apparatus may preclude its use with some paint roller barrels. Also, the protruding lugs may tear the inner surface of the paint roller cover, particularly if the Knowles end cap is inserted after moisture has accumulated inside the roller cover either from the coating being applied or from a previous cleaning of the roller cover. The inventive end cap overcomes these disadvantages by presenting a thin apparatus able to adapt to a wide variety of paint roller barrel lengths or differences in lengths of paint roller covers. The prong of the inventive end cap slide easily into the end of a paint roller without any damage to a damp roller cover, and is configured differently from any structure of Knowles.

None of the above inventions and patents, taken either singly or in combination, is seen to describe the instant invention as claimed.

SUMMARY OF THE INVENTION

The present invention features a universal end cap attachment for a paint roller. The inventive end cap is designed so that textured, paint retaining material on the outer surface of the end cap abuts and conforms to the textured, paint retaining material of the paint roller cover, thereby forming a corner arrangement that will uniformly spread coating material on two intersecting surfaces such as in corners. The end cap is designed for frictional engagement between the inner surface of the paint roller cover and the outer surface for the barrel or cage of the paint roller frame by means of at least one prong situated within not more than a continuous 180° of the perimeter of the end cap. The design of the prong is such that damage to the cardboard core of the paint roller cover is minimized, even if the paint roller cover is wet from being cleaned or from absorption of the coating material being applied. The end cap may be readily inserted and removed during the coating job as required and, in addition, is easily cleanable.

Provision of at least one prong situated within not more than a continuous 180° of the perimeter of the end cap eliminates the problem of alignment of prongs confronting designs having many prongs. At least one prong situated within a not more than a continuous 180° of the perimeter of the end cap is readily inserted between the roller cover and the cage regardless of minor variations in clearances which occur due to manufacturing tolerances. This arrangement accounts for only a limited portion of the circumference of the circular portion of the roller into which it is inserted. The prong is curved at its distal end wherein it engages the roller cover, and is straight at its proximal end wherein it is anchored to the base of the novel end cap. This configuration assists in retaining the prong in engagement with its associated roller assembly.

It is therefor an object of the invention to provide an end cap attachment for a standard paint roller to facilitate the application of coatings to intersecting surfaces and corners.

Another object of the invention is to require only one prong for engaging the a roller frame and roller cover, although more than one prong can be utilized.

A further object of the invention is to compensate for variations in clearance between a roller cover and cage of the roller when inserting a prong of a cap there between.

An additional object of the invention is to configure the prong to be maximally effective in engaging the roller frame and roller cover.

It is a further object of the invention to provide an easily installable and removable attachment which may be used with any commercially available roller frame and roller cover combination.

It is yet another object of the invention to provide an attachment which, in use, spreads a coating uniformly on both intersecting surfaces leaving no visible lines or other defects in the coating on either surface.

It is yet a further object of the invention to provide an attachment for a paint roller which is inexpensive to manufacture.

It is a still further object of the invention to also provide an end cap attachment for a paint roller which is easy to clean.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Generally speaking this invention relates to an attachment for a paint roller, and more specifically, to an end cap for attachment to the end of a paint roller cover to facilitate the spreading of coating materials such as paint in corners or other areas with intersecting surfaces.

Figure 1:
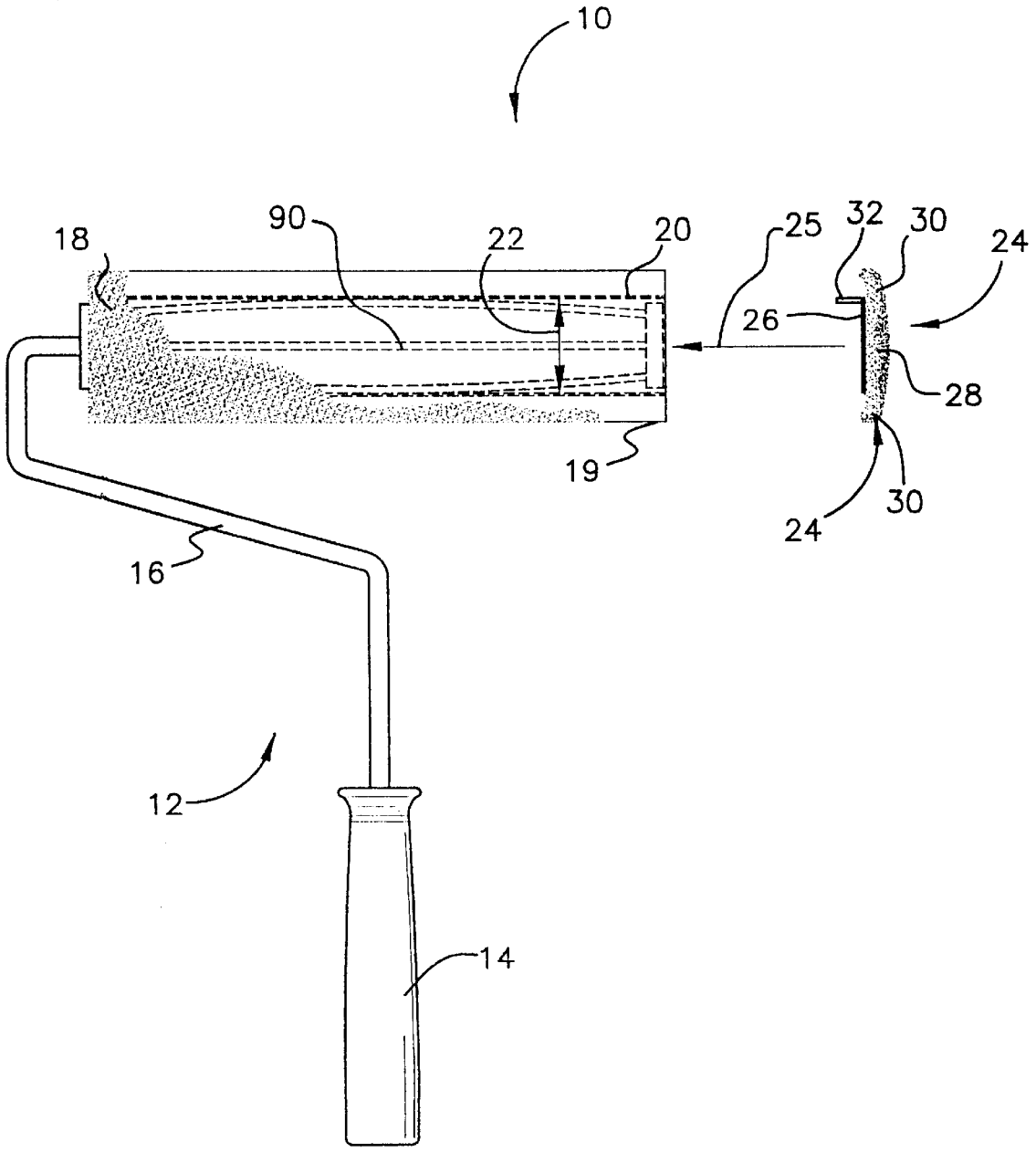
FIG. 1 is a front elevational view of a paint roller frame with the inventive end cap positioned for attachment.
Figure 2:
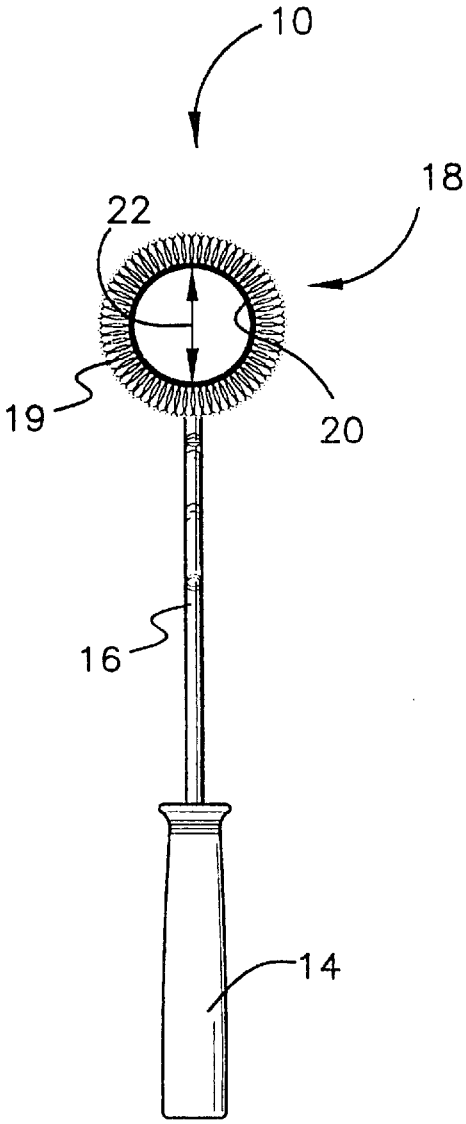
FIG. 2 is a end elevational view of a paint roller frame with a paint roller cover installed.

Referring first to FIGS. 1 and 2, there are shown generally at reference number 10, front and side elevational views respectively, of a typical paint roller assembly 12. Roller assembly 12 includes of a handle 14, a frame 16 with a rotatably-attached cage or barrel 90 which supports a roller cover 18. Roller cover 18 is generally a disposable assembly including a tube 20 having an inner diameter 22. Tube 20 is generally made from cardboard or other similar material and is adapted to frictionally engaging the cage or barrel 90 of roller assembly 12. The outer surface of roller cover 18 is preferably a napped material such as sheepskin 19 suitable for holding and applying a coating material. Sheepskin 19 includes both the skin and also natural wool borne by the skin. Roller covers 18 are widely available in a variety of napped or otherwise textured materials well known to those of skill in the art.

An end cap assembly 24 is shown positioned to the right of paint roller assembly 12 (FIG. 1) in preparation for attachment to roller assembly 12 as shown by direction arrows 25. A thin, essentially flat surface 26 is covered with a textured material 28. The textured material 28 is chosen depending upon the coating material being applied and the contour of the surface to which the coating is being allied. Textiles such as polyester, acrylic, wool, or similar napped materials, and open celled foam such as polyurethane foam or like materials, or even natural sponge, have been found to provide satisfactory service. Generally, the surface of textured material 28 will be chosen to be close to the texture of the material 19 of roller cover 18 to which end cap 24 is being attached. End regions 30 of textured material 28 are formed so that when attached to a paint roller 12, the end regions 30 will abut and conform to the textured material 19 of the roller cover 18 at the point of contact and form a functionally contiguous surface which facilitates the uniform spreading of a coating material on two intersecting surfaces such as in a corner.

At least one prong 32 situated within not more than a continuous 180° of the perimeter of the end cap protrudes essentially perpendicularly from surface 26 for securing end cap 24 to a paint roller 12. In the embodiment chosen for purposes of disclosure, surface 26 and prong 32 are formed unitarily as a single-piece, injection molded polymer structure with textured material 28 attached to surface 26. The prong 32 is formed from a material imparting an outwardly directed spring force so that when prong 32 is in place, the spring force increases normal force acting against the inner surface of tube 20, resultant increased friction tending to hold end cap 24 in place. A variety of materials well known to those skilled in the art may be chosen from which to fabricate the end cap assembly 24.

Prong 32 is designed to be thin enough so that it may be easily inserted into the small space between the inner surface of tube 20 of roller cover 18 and the outer surface of the barrel or cage 90 of roller assembly 12. The prong is long enough to both compensate for variations in either barrel length or roller cover length and also to provide adequate friction so that end cap 24 will not disengage from roller assembly 12 during normal use.

Figure 3:
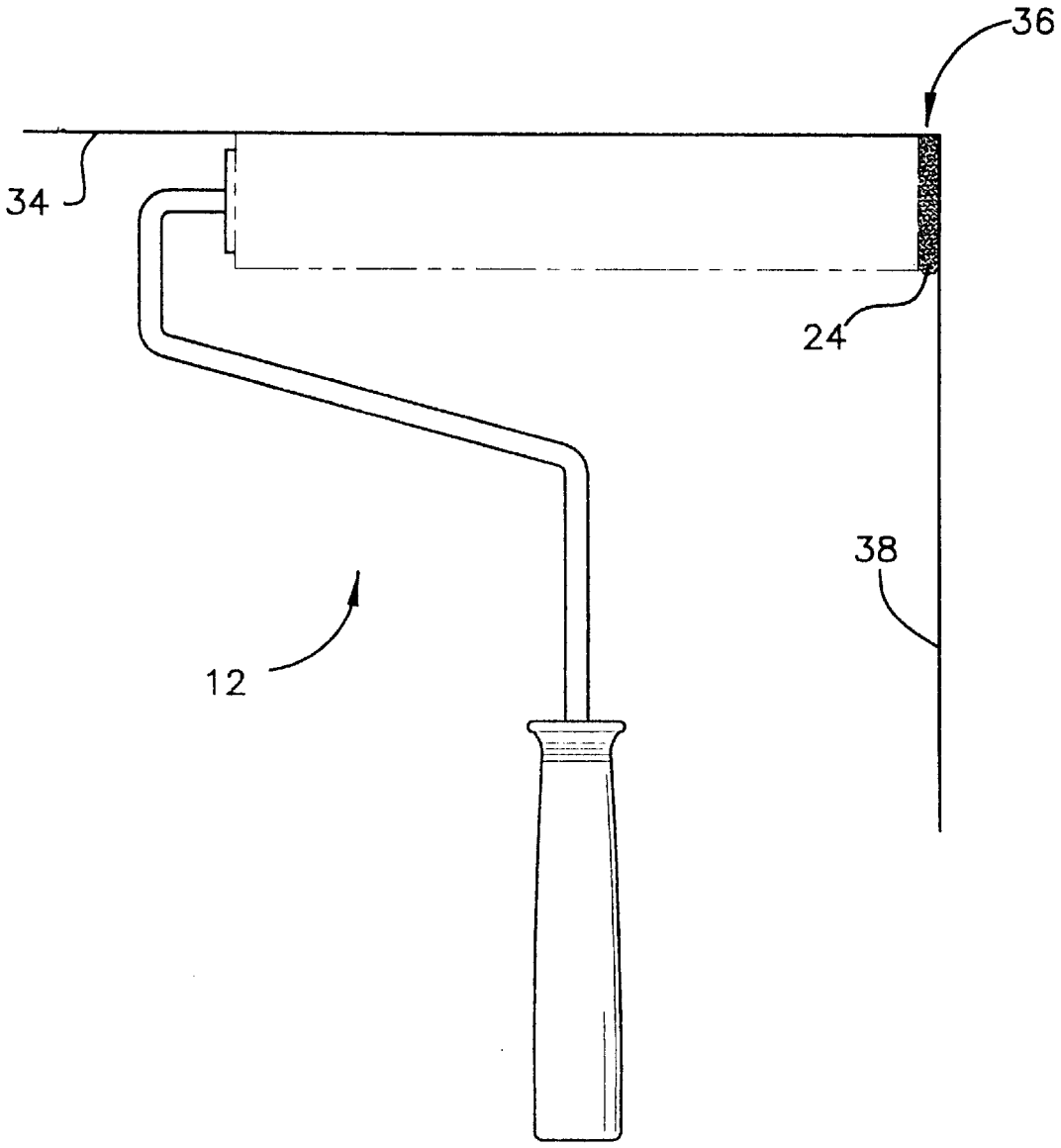
FIG. 3 is a view showing a paint roller with the inventive end cap installed in a typical application.

Referring now to FIG. 3, there is shown a schematic view of a roller assembly 12 equipped with inventive end cap 24 in a typical application. Roller 12 is shown applying paint to a ceiling surface 34 proximate a corner junction 36 with wall 38. The unique formation of end regions 30 (FIG. 1) of napped material 28 allows uniform application of the coating material such as paint to both ceiling surface 34 and wall surface 38 at corner 36. Unlike end caps of the prior art described herein above, the inventive end cap 24 leaves essentially no lines of "missed" coverage or ridges of excess material. When using the end cap of the present invention, the is no need to "cut in" wall 38 near corner 36 because a uniform coating will be applied.

Figure 4:
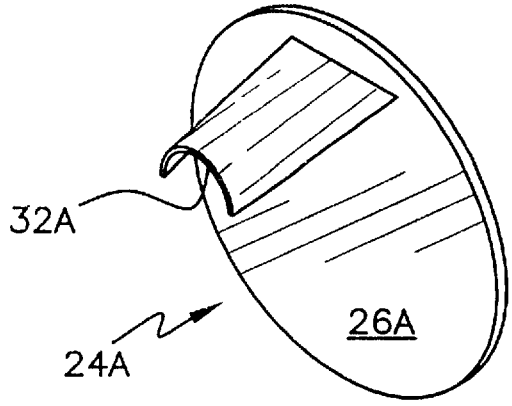
FIG. 4 is a perspective detail view showing one embodiment of the prong of the novel end cap, the latter being seen at the upper right of FIG. 1.

FIG. 4 shows characteristics of the prong representatively shown as 32 in FIG. 1. In the embodiment of FIG. 4, prong 32A is straight at its proximal end where it is anchored to surface 26A, and curved at its distal end. As end cap 24A is inserted into a paint roller assembly 12, cooperation of prong 32A yields to a resistance which enhances frictional grip of end cap 24A. This is a consequence of the increasingly straight configuration of prong 32A, which presses with progressively less cooperation as the point of contact between prong 32A and assembly 12 occurs progressively closer to the proximal end of prong 32A. Poor interfit of the proximal end of prong 32A with paint roller assembly 12 causes the latter to engage the former more securely.

Figure 5:
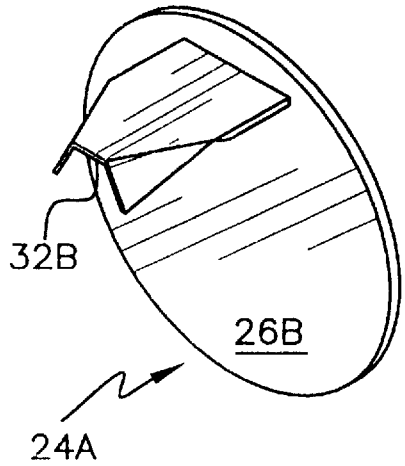
FIG. 5 is a perspective detail view showing another embodiment of the prong of the novel end cap.

FIG. 5 shows a modification of curvature seen in prong 32A of FIG. 4. Whereas the distal end of prong 32A is curved, the distal end of prong 32B of end cap 24B of FIG. 5 has its ends bent such that the end elevational configuration is that of three straight lines collectively forming a generally curved configuration. The overall configuration therefore need not literally be curved. The configuration of the distal end of prong 32B cooperates sufficiently with curvature of paint roller assembly 12 so that insertion is readily accomplished. As insertion progresses, straight configuration of prong 32B at its proximal end near surface 26B causes frictional engagement similar to that of the embodiment of FIG. 4.

Figure 6:
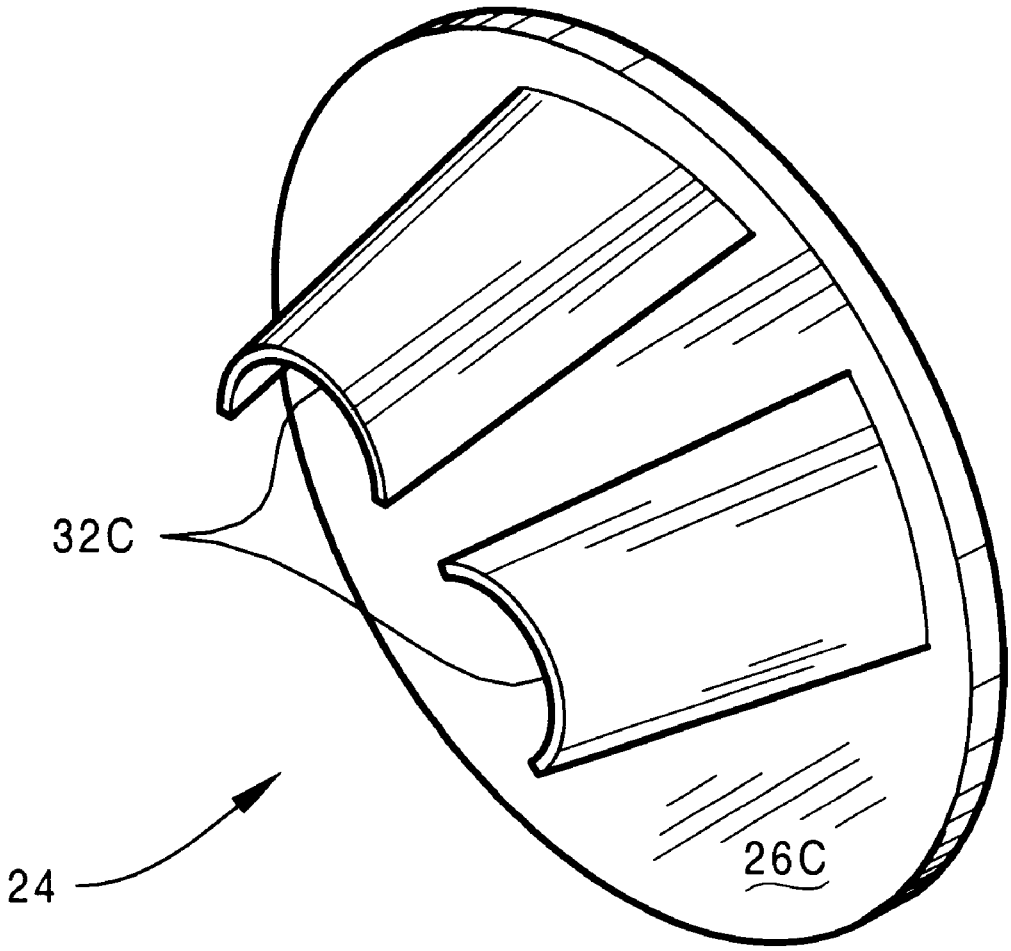
FIG. 6 is a perspective detail view showing another embodiment of the novel end cap having more than one prong.

FIG. 6 shows another modification of prong 32 in which a plurality of prong 32C are arrayed within not more than a continuous 180° of the perimeter of end cap 24C. Placement of prongs 32 on opposite sides of the perimeter of end cap 24 creates opposing displacement between frame 16 and roller cover 18, causing difficulty in installing end cap 24 and distortion of roller cover 18. Placement of prongs 32C within not more than a continuous 180° of the perimeter of end cap 24C creates unilateral displacement between frame 16 and roller cover 18, easing installation and reducing distortion of roller cover 18.

It would be evident to one skilled in the art that the proximal end of prong 32 could be curved, as shown in FIG. 6, to match the inner surface of tube 20, 6 as opposed to flat as shown in FIG. 4 and FIG. 5.

Since other modifications and changes varied to fit particular operating requirements and environments will be apparent to those skilled in the art, the invention is not considered limited to the illustrated embodiments, and covers all changes and modifications which do not constitute a departure from the true spirit and scope of the invention. Having thus described the invention, what is desired to be protected by Letters Patent is presented in the subsequent appended claims.

It is to be understood that the present invention is not limited to the embodiments described above, but encompasses any and all embodiments within the scope of the following claims.

What is claimed is:

1. A paint roller assembly, comprising:

a frame assembly comprising an essentially cylindrical barrel portion adapted to receive a paint roller cover, said essentially cylindrical barrel portion having an outer diameter;

a hollow, cylindrical paint roller cover adapted to spread a coating material, said paint roller cover having an inner diameter and a first distal end for receiving said barrel portion, said paint roller cover being frictionally and coaxially affixed to said barrel portion of said frame assembly, said hollow paint roller cover also having a second distal end; and an end cap assembly for attachment to said paint roller cover and said barrel portion of said frame assembly proximate said second distal end of said paint roller cover, said end cap assembly having a base, a textured, paint retaining material fixed to said base, and a connecting element projecting from said base in a location enabling insertion of said connection element into said frame assembly between said barrel portion of said frame and said paint roller cover, wherein said connecting element comprising at least one prong, situated within not more than a continuous 180° of the perimeter of said base, which retentively engages both the barrel portion and the roller cover.

2. The paint roller assembly, as defined in claim 1, wherein said at least one prong is a thin structure having a straight proximal end fixed to said base of said end cap assembly.

3. The paint roller assembly, as defined in claim 2, wherein said at least one prong has a curved distal end located away from said base of said end cap assembly.

4. The paint roller assembly, as defined in claim 2, wherein said prong is formed from a material exerting an outwardly bearing frictional force against said inner diameter of said paint roller cover, to facilitate holding said end cap assembly in place proximate said second distal end of said paint roller cover.

5. The paint roller assembly, as defined in claim 4, wherein said outer surface adapted to spread a coating material in cooperation with said paint roller is a napped surface having an outer edge, said outer edge being contoured to conform to said paint roller cover proximate said second distal end, thereby forming an essentially contiguous surface for uniformly applying a coating material to at least two intersecting surfaces.

6. The paint roller assembly, as defined in claim 5, wherein said base and said at least one prong of said end cap assembly are formed unitarily from polymer material.

7. The paint roller assembly, as defined in claim 1, wherein said at least one prong is a thin structure having a curved proximal end fixed to said base of said end cap assembly.

8. The paint roller assembly, as defined in claim 7, wherein said at least one prong has a curved distal end located away from said base of said end cap assembly.

9. The paint roller assembly, as defined in claim 1, wherein said textured material comprises fabric.

10. The paint roller assembly, as defined in claim 1, wherein said textured material comprises open celled foam.

11. The paint roller assembly, as defined in claim 10, wherein said foam comprises polyurethane foam.

12. The paint roller assembly, as defined in claim 1, wherein said textured material comprises sheepskin having natural wool borne thereon.

13. A paint roller assembly, comprising:

a frame assembly comprising an essentially cylindrical barrel portion adapted to receive a paint roller cover, said essentially cylindrical barrel portion having an outer diameter;

a hollow, cylindrical paint roller cover adapted to spread a coating material, said paint roller cover having an inner diameter and a first distal end for receiving said barrel portion, said paint roller cover being frictionally and coaxially affixed to said barrel portion of said frame assembly, said hollow paint roller cover also having a second distal end; and an end cap assembly for attachment to said pint roller cover and said barrel portion of said frame assembly proximate said second distal end of said paint roller cover, said end cap assembly having a base, sheepskin having natural wool borne thereon, wherein said sheepskin is fixed to said base, and a connection element comprising at least one prong, situated within not more than a continuous 180° of the perimeter of said base, projecting from said base in a location enabling insertion of said at least one prong into said frame assembly between said barrel portion of said frame and said paint roller cover, thereby retentively engaging said at least one prong there between, wherein said at least one prong is a flat, thin structure having a straight proximal end fixed to said base of said end cap assembly and a curved distal end located away from said base of said end cap assembly, and wherein said at least one prong is formed from a material exerting an outwardly bearing frictional force against said inner diameter of said paint roller cover to facilitate holding said end cap assembly in place proximate said second distal end of said paint roller cover, and wherein said base and said at least one prong of said end cap assembly are formed unitarily from polymer material.

* * * * *